United States Patent [19]

Ohno

[11] Patent Number: 4,743,938

[45] Date of Patent: May 10, 1988

[54] COLOR IMAGE FORMING APPARATUS

[75] Inventor: Akio Ohno, Tokyo, Japan

[73] Assignee: Canon Kabushiki Kaisha, Tokyo, Japan

[21] Appl. No.: 785,618

[22] Filed: Oct. 9, 1985

[30] Foreign Application Priority Data

Oct. 16, 1984 [JP] Japan ..... 59-216935
Oct. 20, 1984 [JP] Japan ..... 59-220869
Oct. 30, 1984 [JP] Japan ..... 59-226655

[51] Int. Cl.[4] ..... G03G 15/06; G03G 15/01

[52] U.S. Cl. ..... 355/3 DD; 355/4; 118/645

[58] Field of Search ..... 355/4, 3 DD, 3 R; 118/645

[56] References Cited

U.S. PATENT DOCUMENTS 4,030,445 6/1977 Takenaga et al. ..... 355/4 X

FOREIGN PATENT DOCUMENTS 0124732 9/1979 Japan ..... 355/4
0111555 7/1982 Japan ..... 355/4

*Primary Examiner*—R. L. Moses

*Attorney, Agent, or Firm*—Fitzpatrick, Cella, Harper & Scinto

[57] ABSTRACT

A color image forming apparatus provided with a developing device for developing latent images formed on a latent image bearing member. The developing device includes a rotary assembly for carrying a plurality of developing units so that the developing units revolve by the rotation of the rotary assembly, so as to dispose a desired or necessary one of the developing units at a developing station where the latent image on the latent image bearing member is developed. Each of the developing units is provided with an element or elements to be driven, such as a developing roller or the like. A single driving mechanism is provided in the image forming apparatus, which driving mechanism can drive any of the developing units when it is placed at the developing position. For this purpose, the driving mechanism is engageable with that one of the developing units revolvable on the rotary assembly which is located at the developing station to develop the latent image on the latent image bearing member, so that the driving force is transmitted to the element of the unit requiring the driving force.

17 Claims, 14 Drawing Sheets

COLOR IMAGE FORMING APPARATUS

FIELD OF THE INVENTION AND RELATED ART

The present invention relates to a color image forming apparatus such as a color electrophotographic copying apparatus or a color recording apparatus constituting an output part of a computer or a facsimile machine. More particularly, it relates to a color image forming apparatus comprising a developing mechanism provided with a plurality of developing units carried on a unit carrier wherein a desired, one of the plural developing units is rotationally disposed so as to oppose a latent image bearing member at a developing position where the latent image is developed thereby. In the present invention, the developing mechanism of the color image forming apparatus is not limited to that for a full-color (pictorial) development, but is applicable to two color, three color or multi-color development depending on the number of the developers used.

In this specification, however, the description will be made with respect to a full-color electrophotograpic copying apparatus provided with the developing mechanism for a full-color development as a typical example of the color image forming apparatus. As will become clear with the description hereinafter, the developing units effect circular movement, but other rotational movements such as an oval movement or the like, are included.

Recently, the demand has increasing for the formation of color images not only in special fields but also in the fields of ordinally office work, and therefore, a color image forming apparatus is desired, which can be operated by non-expert users. To meet this demand, a full-color electrophotographic copying apparatus using an electrophotograpic technique is becoming available as the color image forming apparatus.

The full-color electrophotographic copying apparatus still involves unsolved problems and various points to be improved. One of them is how to arrange and construct the developing device for visualizing the electrostatic latent image formed on a photosensitive member which serves as a latent image bearing member in the electrophotography.

Many types of developing devices have been proposed for use in a color electrophotographic copying machine. Generally, those are divided into two categories, in one of which a plurality of developing units containing different color developers are arranged in series around the circumferential periphery of the photosensitive drum. It seems on its surface that the structure is simple on the ground that the plural developing units are simply arranged along the surface of the photosensitive drum. Actually however, it requires that when one of the developing units is in operation, all of the rest of the developing units are maintained in an inoperative state. This necessiates the provision of means for controlling the rotations of developing rollers in the developing units and for shifting the inoperative developing units away from the photosensitive drum surface. As a result, this type of the developing device can not avoid a complicated structure and a complicated operational control.

Further, this type of the developing device unavoidably requires a large diameter of the photosensitive drum because the plural developing units much be disposed along the surface thereof, leading to the difficulties in reducing the size of an electrophotographic copying apparatus. Moreover, the developing stations where the respective developing units perform the developing operations, are different in position despite the fact that the position where the latent image is formed on the photosensitive drum is constant; and therefore, the time period required from the latent image formation to the development is different depending on the individual developing units, which requires some correction on the basis of the attenuation of the latent image with time, as the case may be. This correction is not easy, and requires a complicated overall control of the copying machine and the developing device.

In the other type of the developing device, as shown in Japanese Patent Application Publications Nos. 20579/1980, 25218/1884, a plurality of developing units are supported on a unit carrier. The carrier is rotatable to oppose only a necessary developing unit to the photosensitive drum to effect the development. This is known as a rotary type developing device. Since only one developing unit is opposed at the developing position in the rotary developing device, it is not necessary for the photosensitive drum to have a large diameter as in the aforementioned type of the developing device. Therefore, the size of the photosensitive drum can be reduced, so that the size of the color electrophotographic copying apparatus can be reduced, too. Additionally, since the position of the development is constant, the correction depending on the latent image attenuation is not required.

Heretofore, however, there has not been proposed any practical solution to the problem as to how to efficiently drive the units.

SUMMARY OF THE INVENTION

Accordingly, it is a principal object of the present invention to provide a color image forming apparatus provided with a developing device wherein a plurality of developing units are revolved so that a desired or necessary one of the developing units is placed at the developing position for the developing operation thereof, the developing units being driven by a driving device.

It is another object of the present invention to provide a color image forming apparatus provided with a driving device which can be smoothly connected to a driven part of each of the developing units and is not liable to damage the driven part of each of the developing units.

It is a further object of the present invention to provide an image forming apparatus provided with a driving device which can be operatively connected with certainty to the driven part of each of the developing units even when the driven part is positionally deviated by a small amount.

It is a yet a further object of the present invention to provide a color image forming apparatus which does not require a driving device for each of the developing units so that the structure of the developing unit, and therefore, that of the developing device as a whole are simplified, with the result of easy maintenance.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
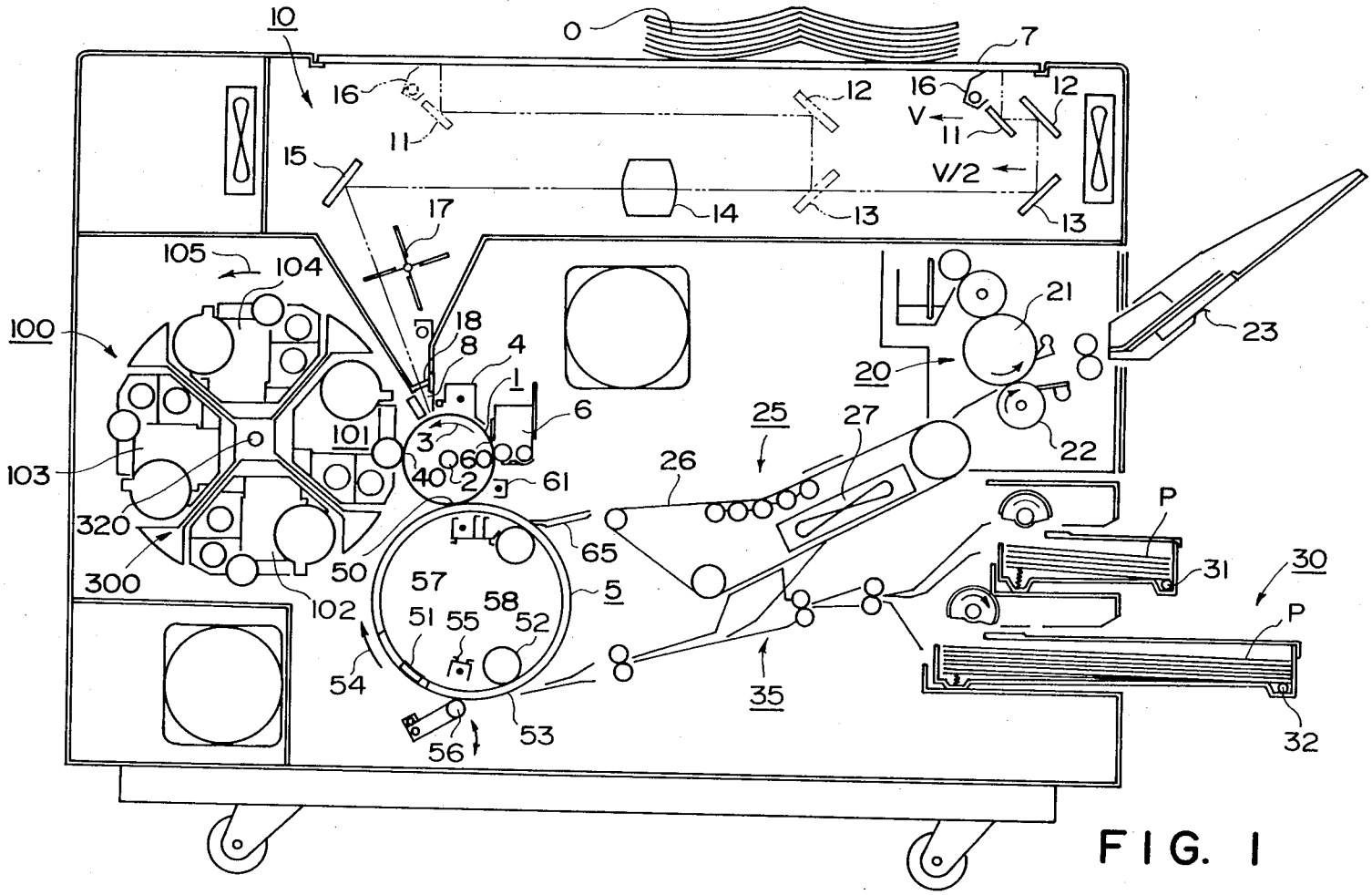
FIG. 1 is a sectional view of a full-color electrophotograpic copying apparatus according to an embodiment of the present invention.

Referring now to FIG. 1, there is shown an exemplary color image forming apparatus in the form of a full-color electrophotographic copying apparatus.

The full-color electrophotographic copying apparatus may use various electrostatic latent image forming processes such as a so-called NP process (U.S. Pat. No. 3478306) comprising primary charging, simultaneous color-separated image exposure and DC charging (with the polarity opposite to that of the primary charge) or AC charge removing, and a whole surface exposure; and so-called Carlson process comprising primary charging and color-separated image exposure. In this specification, the description will be made with the apparatus using the Carlson process.

FIG. 1 shows the general arrangement of the full-color electrophotographic copying apparatus in cross-section. In the middle of the copying machine, there is a photosensitive drum 1 having a surface layer of an electrophotograpic photosensitive layer. The photosensitive drum 1 is rotatably and detachably mounted on a supporting shaft 2 in a known manner. In this embodiment, the photosensitive drum 1 rotates in the direction shown by an arrow 3, that is, in the counterclockwise direction as seen in FIG. 1.

Substantially right above the photosensitive drum 1, there is provided a primary charger 4. In the lefthand side of the apparatus, it comprises a revolvable or rotatable developing device 100. The copying apparatus further comprises an image transfer drum 5 below the photosensitive drum 1 and a cleaning device 6 at the righthand side of the photosensitive drum 1 as seen in FIG. 1. The copying machine is provided with an optical system 10 in the upper part thereof, which is effective to project a light image of an original O placed on a platen 7 onto the photosensitive drum 1 at an exposure position 8 which is between the primary charger 4 and the developing device 100. The optical system 10 may be any of known type, and in this embodiment it comprises a first scanning mirror 11, second and third scanning mirrors 12 and 13 movable in the same direction as the first scanning mirror 11 but at a speed equal to one half of that of the first scanning mirror 11, an imaging lens 14 and a fourth mirror 15 which is fixed. Since the optical system 10 is one of the known systems, further description will not be necessary. An original illuminating light source 16 is movable together with the first scanning mirror 11, and a color separating filter 17 is disposed optically between the fourth mirror 15 and the exposure position 8.

The light image of the original O formed by the reflected light by the first, second and third scanning mirrors 11, 12 and 13, is transmitted through the lens 14 and by way of the fixed mirror 15 to reach a color-separation filter 17 by which the light image is color-separated. The color-separated image is projected onto the photosensitive drum 1 in focus at the exposure position 8 through dust-proof glass 18.

In the righthand side of the copying apparatus of FIG. 1, a fixing device 20 and a sheet feeding device 30 for feeding transfer materials are provided. Transfer material guides 25 and 35 are provided between the transfer drum 5 and the sheet feeding device 30 and between the transfer drum 5 and the fixing device 20.

In operation, the photosensitive drum 1 rotates in the direction of the arrow 3 and is electrically charged by a primary charger 4. The photosensitive drum 1 is then slit-exposed to the light image of the original through the optical system 10 at the exposure station 8 so that an electrostatic latent image of the color-separated image is formed on the photosensitive drum 1. With the continued rotation of the photosensitive drum 1, the latent image thereon is conveyed to the developing position 40 where there is a rotatable developing device 100, whereby the electrostatic latent image is developed into a visualized toner image by that one of the developing units in the rotary developing device 100 which is opposed to the photosensitive drum 1.

The rotary developing device 100, as will be described in detail hereinafter, comprises a rotary assembly 300 rotatably supported on a shaft 320. The rotary assembly 300 carries a plurality, four, in this embodiment, of developing units 101, 102, 103 and 104 which are detachable therefrom. In the case of two color image forming apparatus, only two developing units may be employed, which are for example for red and black.

In the embodiment, the developing units 101, 102, 103 and 104 are for yellow toner, magenta toner, cyan toner and black toner, respectively. The black toner developing units 104 may be omitted depending on the situation.

In the full-color electrophotographic copying process, the developments are usually executed in the order of yellow, magenta, cyan and black. Therefore, in the first electrostatic latent image formation process in the FIG. 1 apparatus, a blue filter of the color-separation filter 11 is placed across the optical path of the image. And, the yellow toner developing unit 101 is opposed to the photosensitive member at the developing position 40. The developing unit 101 is driven by a driving device according to the present invention (which will be described in detail hereinafter) to effect the developing operation.

The latent image is developed by the developing unit 101 into a yellow image, and thereafter, the yellow image is conveyed with the continued rotation of the photosensitive drum 1 to an image transfer station 50 where the photosensitive drum 5 is provided. The transfer drum 5 is provided with a gripper 51 at a position on its periphery. The gripper 51 is opened by a gripper cam 52 mounted inside the transfer drum 5 when the gripper 51 comes to a gripping position 53, so that it grips the leading edge portion of the transfer material P which is fed to the gripping position 53 through the transfer material feeding system 35 from either one of the transfer material cassettes 31 and 32 disposed in the sheet feeding device 40. The material of the transfer material P may be composed of known materials. However, it is most frequently paper, and therefore the material P is called a "transfer sheet". The transfer sheet P gripped by the gripper 51 is moved together with the rotation of the transfer drum 5 in the direction of an arrow 54, that is, the clockwise direction in FIG. 1. During this movement, the transfer sheet P is attracted to and contacts the to outer periphery of the transfer drum 5 by means of an attracting charger 55 within the transfer drum 5 and a confining roller 56 urged to the outer periphery of the transfer drum 5. In this state, the transfer sheet P is conveyed to the transfer position 50, where the yellow image formed on the photosensitive drum 1 as described above is transferred onto the transfer sheet P. Inside the transfer drum 1, a transfer charger 57 is provided.

The photosensitive drum 1 which has received the yellow toner image is electrically discharged by a charge removing discharger 61, and is then cleaned by a resilient blade of the cleaning device 6 so that residual toner is removed from the photosensitive drum 1. Thus, the image forming process completes for the yellow image. In the similar manner a, magenta image, a cyan image and a black image are formed. When the magenta image is formed, a green filter of the color-separation filter 11 is used, and the magenta toner developing unit 102 is used. To allow this, the rotary assembly 300 is rotated in the direction of an arrow 105, that is, the counterclockwise direction after the development of the yellow image, so as to oppose the magenta toner developing unit 102 to the photosensitive drum 1 at the developing position 40. In the cyan image formation, a red filter and the cyan toner developing unit 103 are used. In the black image formation, no color separation filter 11 is used, and the development is effected with the black toner developing unit 104.

On the other hand, the transfer drum 5 continues to rotate while keeping the transfer sheet P thereon so that the transfer sheet P passes through the image transfer position during the magenta, cyan and black image forming operations, whereby each of the toner images are transferred onto the same transfer sheet P in alignment with each other.

After the transfer of the final color-separated image, the photosensitive drum 1 is discharged by the discharger so that the residual potential is removed, and then it is cleaned by the cleaning device. Then, the apparatus is either stopped or is started again for the next process.

The transfer drum 5, after the final color-separated image, that is, the black image, is transferred onto the transfer sheet P, the gripper 51 operates the gripper cam 58 so as to release the transfer sheet P from the gripper. The released transfer sheet P is separated from the transfer drum 5 by a separation pawl 65 and is conveyed to the transfer material conveying system 25. It may be of any known type and usually comprises a conveying belt 26 and attracting means 27. The transfer sheet P is transported to the fixing device 20 by the conveying system 25. The fixing device 20 comprises a couple of fixing rollers 21 and 22, which are effective to press and heat the transfer sheet P so as to fix the toner image, and thereafter, the transfer sheet P is discharged to a tray 23.

Figure 2:
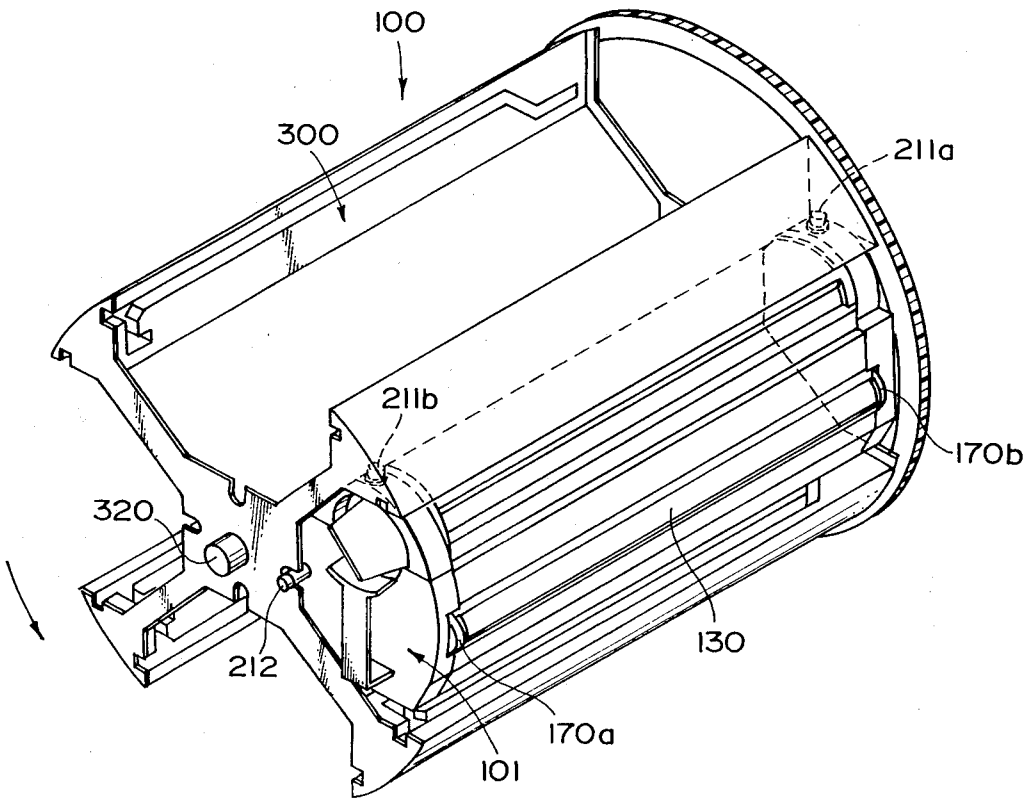
FIG. 2 is a perspective view of a rotary developing device usable with the electrophotographic apparatus of FIG. 1.
Figure 3:
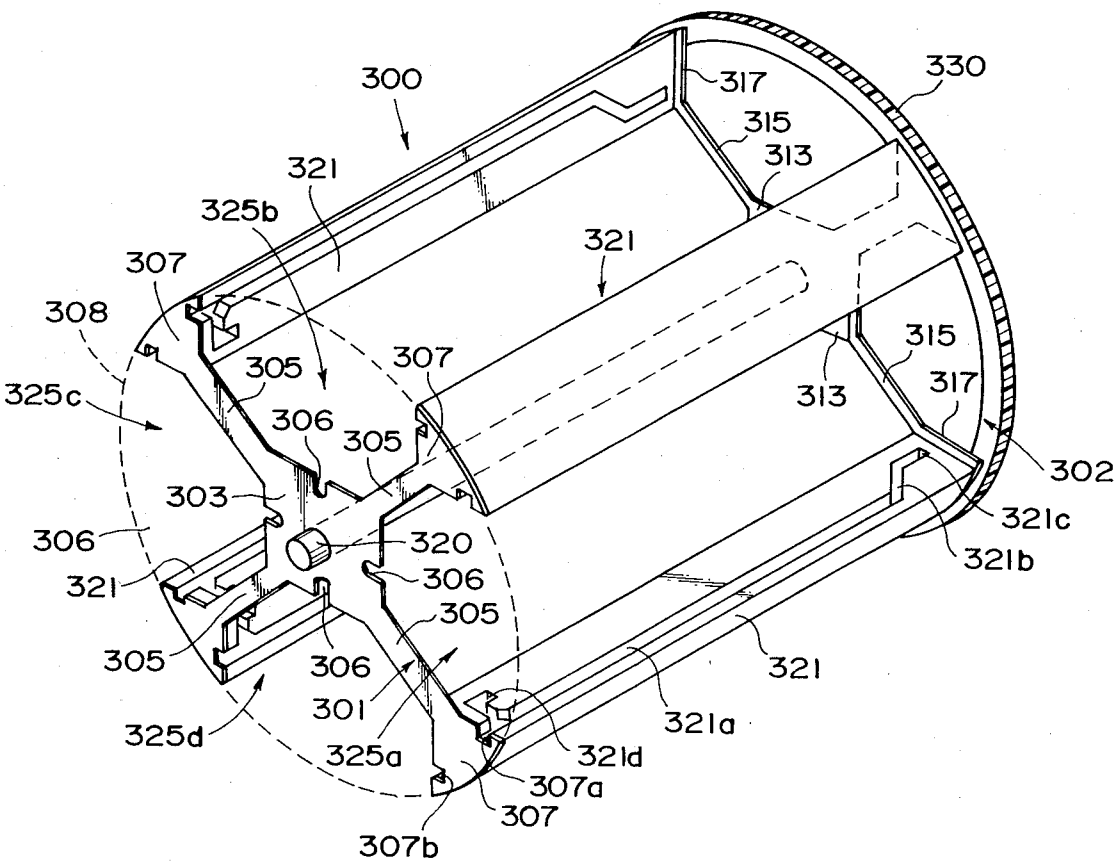
FIG. 3 is a perspective view of a rotary assembly of the rotary developing device of FIG. 2.
Figure 4:
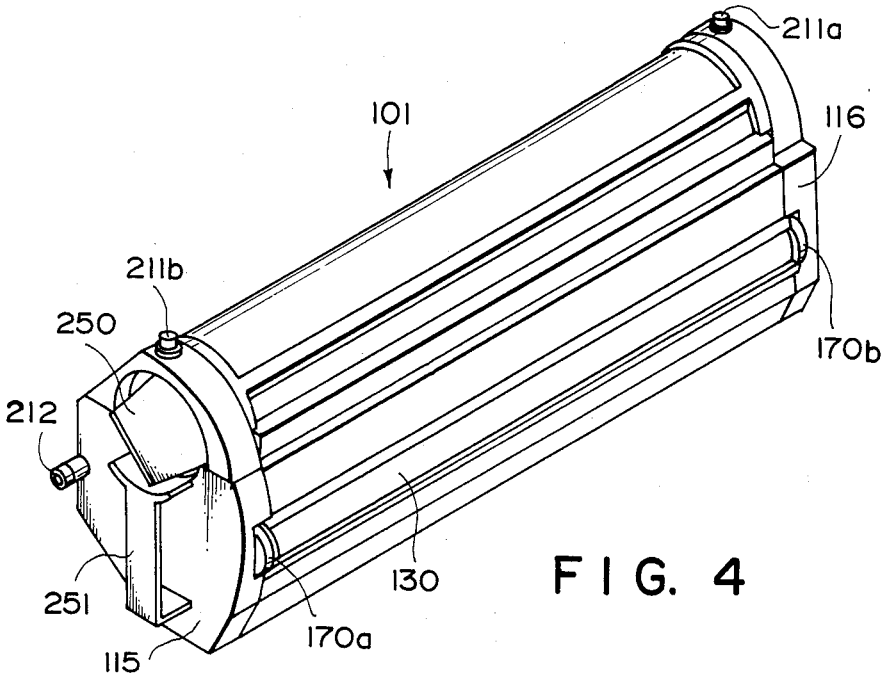
FIG. 4 is a perspective view of a developing unit carried on the rotary assembly shown in FIG. 3.
Figure 5:
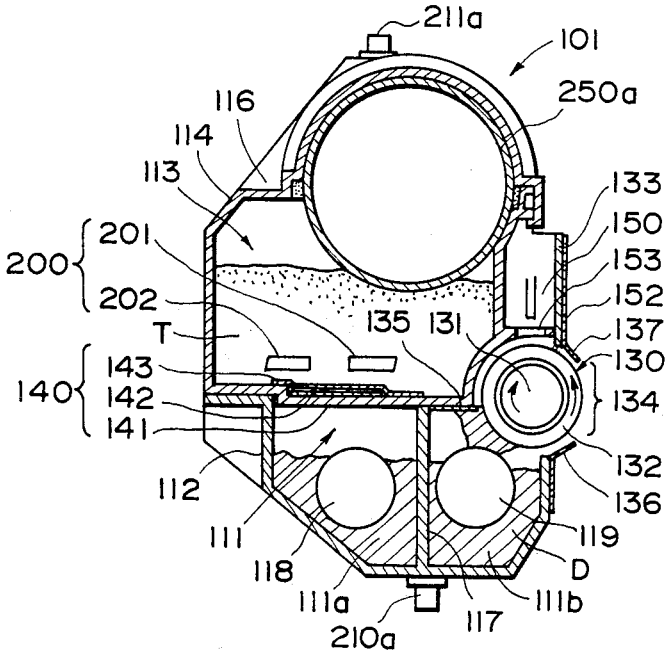
FIG. 5 is a sectional view of the developing unit of FIG. 4.

Now, a description will be provided of the rotatable developing device 100. As best seen in FIGS. 2, 3 and 4, the rotatable developing device 100 comprises a rotary assembly 300 rotatably supported on the frame of the copying apparatus by means of a shaft 320, and a plurality of developing units 101, 102, 103 and 104 detachably mounted to the rotary assembly 300. The developing units are essentially of the same structure and configuration, and the appearance thereof is shown in FIG. 4, and the cross-section is shown in FIG. 5. In FIG. 2, the rotary assembly 300 is illustrated as carrying only the yellow toner developing unit 101 and being deprived of the rest of the developing units, 102, 103 and 104. FIG. 3 illustrates the rotary assembly 300 without any developing unit.

The developing units will be described first. Because of the essential identity in structure, only a description of the yellow toner developing unit 101 will be provided. In this embodiment, each of the developing units 101–104 contains a two component developer comprising toner containing as main its main component a polyester resin with a dye or pigment for each of the colors and the carrier particles of magnetic material. However, the invention is not limited to this embodiment, and another toner, a one component developer for example, may be used.

Figure 6:
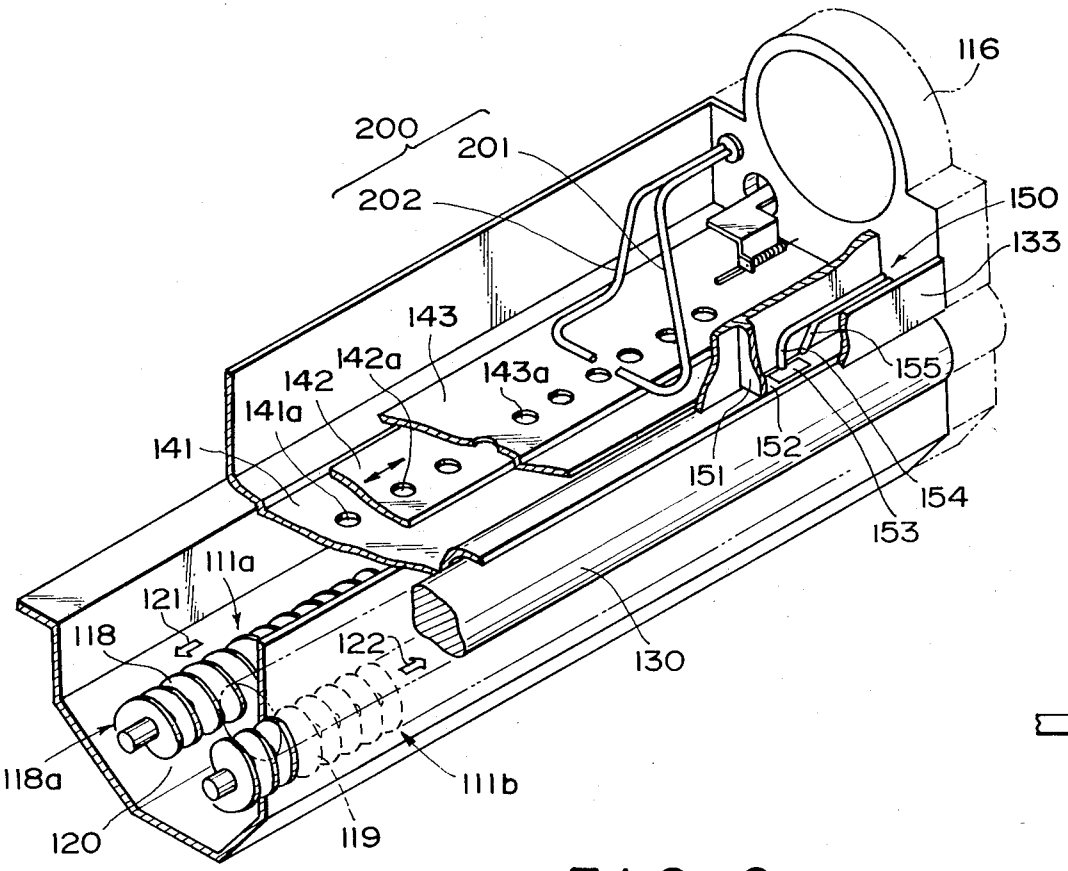
FIG. 6 is a partly broken perspective view illustrating the inside of the developing unit of FIG. 4.

As will be understood from FIGS. 5 and 6, the developing unit 101 comprises a bottom housing 112 for defining the developer chamber 111 for accommodating the developer D containing the carrier and toner, and a top housing 114 for defining a toner chamber for accommodating the toner to be supplied to the developer chamber 111, the top housing being integral with the bottom housing 112 thereabove. The bottom housing 112 has a U-shaped cross-section and is elongated in the direction of the length of the photosensitive drum 1. The top housing 114 extends to the same extent as the bottom housing 112. Those housings 112 and 114 are integrally superposed, and end members 115 and 116 are mounted to the opposite ends thereof, as shown in FIG. 4. The developer chamber 111 is divided by the partition plate 117 into two chambers, namely, a first developer chamber **111*a* and a second developer chamber 111*b*. Each of the first and second developer chambers 111*a* and 111*b* is provided with a stirring screw 118 or 119 which is rotatable. The partition plate 117, as best seen in FIG. 6, falls short of the opposite ends of the developer chamber 111** adjacent to the end members 115 and 116 so that communication passages 120 are formed between the first and second developer chambers 111*a* and 111*b*, although the communication passage adjacent the rear side of the developer chamber 111 adjacent to the end member 116 is not shown. When the stirring screws 118 and 119 are driven in the manner which will be described hereinafter, the developer D in the first developer chamber 111*a* is transferred from the rear side of the developer chamber to the front side thereof in the direction indicated by an arrow 121 so that the developer D in the second developer chamber 111*b* is transported from the front side of the developer chamber to the rear side thereof in the direction of an arrow 122. The front side part 118*a* of the stirring screw 118 screws in the direction opposite to that of the rest part thereof. The rear side part (not shown) of the stirring screw 119 similarly screws in the direction opposite to that of the rest thereof. Therefore, the developer D transported to the front side of the first developer chamber 111*a* is continuously supplied to the second developer chamber 111*b* through the communication passage, and similarly, the developer D transported to the rear side of the second developer chamber 111*b* is continuously supplied to the first developer chamber 111*a*. In other words, because of the above-described structure, the developer D in the developer chamber 111 is continuously circulated in the direction of arrows 121 and 122 through the first and second developer chamber 111*a* and 111*b*. The circulating movement is effective to uniformly stir and mix the toner and carrier in the developer chamber 111 with the result of less variation in the developer density in the developer chamber 111.

A developing roller 130 is disposed above the developer chamber 111, more particularly, the second developer chamber 111*b* in this embodiment. The developing roller 130 comprises a magnet roller 131 rotatably mounted to the developing unit 101, and a sleeve 132 of non-magnetic material which is rotatable and which encloses the magnet roller 131. The magnet roller 131 and the sleeve 132 are rotated in the opposite directions, more particularly in this embodiment, the sleeve 132 is rotated in the counterclockwise direction as seen in FIG. 5, while the magnet roller 131 is rotated in the clockwise direction. The directions of rotations are not limited to those noted above, but may be opposite to those detailed above. In a possible alternative embodiment one of the sleeve 132 and the magnet roller 131 is fixed, while the other is rotated.

The developer D moving in the second developer chamber 111*b* is attracted upwardly toward the developing roller 130 by the magnetic force provided by the magnet roller 131 therein, and the developer is formed into a magnetic brush on the outer periphery of the sleeve 132. The particles of the developer carried on the surface of the sleeve 132 rotate on the sleeve 132 with the rotation thereof and move in the clockwise direction. A doctor blade 133 is provided to regulate the height of the magnetic brush. In this manner, the toner is applied to the photosensitive drum 1 at the developing position (FIG. 1). The developer not consumed in the developing action and remaining on the sleeve 132 is returned into the developer chamber 111 by the continued rotation of the developing roller 130, while being carried on the sleeve 132. More particularly, the developer is returned to the second developer chamber 111*b*, where a scraping blade 135 scrapes the developer off the surface of the sleeve 132. The area of the sleeve 131 exposed to the photosensitive drum 1 is defined by the opening 134 formed by the opening limiting members 136 and 137. The magnet roller 131 of the developing roller 130 forms a magnetic field adjacent the opening 134 sufficient to prevent the developer in the developer chamber 111 from leaking therethrough when the opening 134 is faced downwardly, as disclosed in Japanese Patent Application Publication No. 20579/1980 under the name of the assignee of the present application.

The toner chamber 113 is formed above the developer chamber 111. The toner chamber 113 stores the toner to be supplied. From the toner chamber 113, the amount of the toner substantially equal to that of the toner consumed for development from the developer chamber 111 is supplied to the developer chamber 111, more particularly in this embodiment, to the first developer chamber 111*a*. Thus, a constant toner content is maintained in the developer D in the developer chamber 111.

Next, the toner supplying means 140 in the toner chamber 113 will be described. The toner supplying means 140 is constituted by the bottom wall of the top housing 114 for defining the toner chamber 130, that is, the partition 141 between the top housing 114 and the bottom housing 112, a shutter plate 142 slidably reciprocable on the partition 141 in the direction of an arrow, and a regulating plate 143 fixed to the partition 141 and covering the shutter plate 142. The partition 141 is provided with through openings 141*a* arranged at regular intervals from the front side to the rear side. The shutter plate 142 and the regulating plate 143 are each provided with the through openings 142*a* and 143*a* at the same intervals as of the openings 141*a* of the partition 141. The three series of the openings 141*a*, 142*a* and 143*a* are aligned on a line in the direction of slide of the shutter plate 142. However, at least the openings 141*a* of the partition 141 and the openings 142*a* of the shutter plate 142 are offset. Therefore, when the toner supplying means 140 is in an inoperative position, the openings 141*a* of the partition 141 are closed by the shutter plate 142, so that the toner in the toner chamber 113 does not fall into the developer chamber 111.

Figure 7:
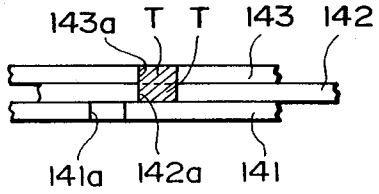
FIGS. 7 and 8 is a partly sectional view of a toner supplying device.
Figure 8:
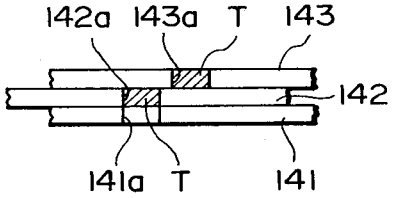

FIG. 7 illustrates the relation among the openings 141*a*, the openings 142*a* and the openings 143*a* of the partition 141, the shutter plate 142 and the regulating member 143, respectively, when in the inoperative position of the toner supplying means 140. The openings 142*a* of the shutter plate 142 are in alignment with the openings 143*a* of the regulating plate 143, so that a part of the toner T in the toner chamber 113 fills the openings 142*a* of the shutter plate 142 through the openings 143*a*. When the shutter plate 142 is moved by unshown driving means, the shutter plate 142 slides with its openings 142*a* filled with the toner T to such an extent that the openings 142*a* are aligned with the openings 141*a* of the partition 141. By this, the toner T filling the openings 142*a* of the shutter plate 142 falls into the developer chamber 111 through the openings 141*a* of the partition 141. As will be readily understood, the amount of supply of the toner T to the developer chamber 111 is regulated by the number and size of the openings 142*a* of the shutter plate 142, and by the number and size of the openings 141*a* and 143*a* of the partition 141 and the regulating plate 143, as the case may be; and one sliding movement of the shutter plate 142 supplies a constant amount of toner to the developer chamber 111. The number of sliding movements of the shutter plate 142 is not limited to one, but it may be plural depending on the toner consumption in the developer chamber 111.

Next, developer concentration detecting means will be described. As shown in FIGS. 5 and 6, each of the developing units is provided with the developer concentration or content detecting portion 150 above the developing roller 130. The detecting portion 150 is disposed at the rear side of the developing unit 101, for example, and adjacent one side of the top housing 114 and is enclosed by the doctor blade 133, the end plates 116, the side wall 151 and the bottom wall 152 integral with the top housing 114. The bottom wall 152 is provided with a transparent window 153 at a location opposed to the sleeve 132 of the developing roller 130.

The concentration detecting portion 150 is further provided with a couple of optical fiber means 154 and 155. The optical fiber means 154 is effective to guide into the detecting portion 150 the light introduced from the outside of the developing unit, and to apply the light onto the outer periphery of the developing roller 130 through the transparent window 153. On the other hand, the optical fiber means 155 is effective to receive the light emitted from the optical fiber means 154 and then reflected by the developing roller 130, and to guide the light to a concentration detector disposed outside the developing unit. The quantity of the light received by the optical fiber 155 varies depending on the amount of the toner contained in the developer on the developing roller 130. When the concentration is reduced below a predetermined level, the above-described shutter plate 142 is operated to supply the toner.

On the other hand, the toner chamber 113 of each of the developing units is provided with means 200 for detecting the amount of the toner remaining therein, adjacent to the toner supplying means 140 located at the bottom thereof. The toner detecting means 200 comprises optical fiber means 201 and 202 disposed opposed to each other in the toner chamber 113. The optical fiber means 201 and 202 receives the light from a light source of the toner detecting device disposed outside the developing unit. By this structure, the presence and/or absence of the toner in the toner chamber 113 can be detected. When a signal representing "no toner" is produced by the toner detecting means, the toner is supplied to the toner chamber 113 by proper means, which is known.

The entire structure of the rotatable developing device 100 will be now described, which is provided with a plurality of developing units, four units in this embodiment.

FIG. 2 discloses a rotary member 300 carrying the developing units 101, while FIG. 3 illustrates the rotary member 300 alone. The rotary member 300 includes a front plate 301 which is at the side (near the operator when mounted in the copying apparatus) and a rear plate 302 at the rear side thereof (remote from the operator). The front plate 301 includes a central plate 303 substantially in the form of a regular square, and arms 305 extending outwardly from the four corners of the central plate 303. The outside edges of the central plate 303 is provided with a cut-away portions 306 for the purpose which will be described hereinafter. Each of the arms 305 has an outside end formed into an enlarged head 307. The outer surfaces of the heads 307 of the arms 305 is formed into parts of a phantom circle 308. The sides of each of the heads 307 is provided with cut-away portions **307*a* and 307*b***.

The rear plate 302 has the similar configuration and is provided with the central plate 313, the arms 315 and the heads 317. However, there is no cut-away portion 306 or **307*a*, 307*b* as contrasted to the front side central plate 313 and the arms 317**.

The front plate 301 and the rear plate 302 are connected to be integral by a rotational shaft 320 disposed at the center and extending slightly outwardly from the opposite central plates 303 and 313 and by four rails 321 (stays) between the corresponding heads of the opposite plates. With this construction, the rotary assembly defines a developing unit accommodating chambers **325*a*, 325*b*, 325*c* and 325*d* for accommodating the developing units 101, 102, 103 and 104**, respectively.

Each of the rails 321 has at both lateral sides guiding slots **321*a*, 321*b*, 321*c* and 321*d* in alignment with the cut-away portions 307*a* and 307*b* of the head 307. The cut-away portion and the guiding slots are effective to be engaged with pins 210*a*, 210*b* and 211*a*, 211*b* (FIGS. 4 and 5) provided at the bottom and top of the end plates 115 and 116 of the developing unit, 101** for example, and is effective to guide each of the developing units into the respective accommodating chamber of the rotary assembly.

The rear plate 302 is provided with a gear 330 integrally fixed thereto for rotating the rotary assembly to revolve the developing units carried thereon. When the rotary assembly 300 is inserted into the copying machine, and then the rotational axis 302 is rotatably supported on an unshown bearing of the copying machine, as shown in FIG. 9, the gear 330 is operatively meshed with driving means 400 disposed at proper position for the meshing engagement.

Driving means 400 for rotating the rotary assembly 300 includes a motor M1 having an output shaft 402. The driving force is transmitted to a driving gear 330 through the gears 403, 404 and 405. A rotary encoder 401 is directly connected with the motor M1 so as to detect the speed and amount of rotation of the rotary assembly 300, in accordance with which the speed of the developing unit movement is controlled by a driver circuit as shown in U.S. Ser. No. 739,838 filed on May 31, 1985.

Adjacent to the rear plate 302 and a driving gear 330 of the rotary assembly, there are provided means 420 for determining the position of the rotary assembly 300, driving means 430 for the developing unit for supplyig driving power to the developing roller and the other of the developing unit disposed at the developing position (this will be described in detail hereinafter), means 450 connected to the developing unit and detecting various pieces of information relating to the developing unit, the developer concentration and the amount of the remaining toner, for example. Adjacent to the same, are means 470 for supplying a driving force for effecting the sliding movement of the shutter plate 142 of the toner supplying means 140 and means 380 for detecting the position of the rotary assembly 300. Those means are provided on the copying apparatus side.

Figure 9:
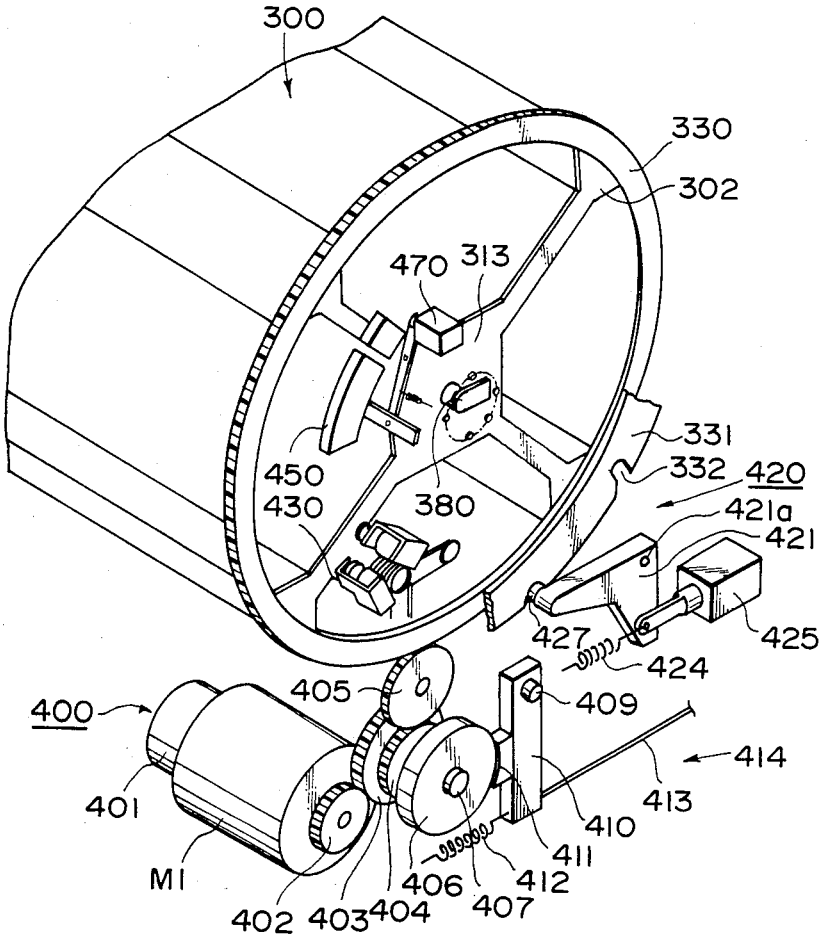
FIG. 9 is a perspective view of the rotary developing device seen from the rear side thereof.

The rotary assembly 300, as shown in FIG. 9, is correctly positioned by engagement of a positioning pin 427 of the positioning lever 421 to a stopper member 331 fixed to the driving gear 330 or the rear plate 302. The stopper member 331 is in the form of an annular ring as shown in FIG. 9, and can have that number of cut-away portions 332 for engagement with the positioning pin 427 along the outer circle of the rotary assembly 300, which corresponds to the number of stopping positions of the rotary assembly 300. In order to disengage the positioning pin 427 from the cut-away portion 332, the solenoid 425 is actuated to attract the lever 421 against the spring force provided by the spring 424 which is in the direction of engaging the positioning pin 427 into this cut-away portion 332. By the actuation, the positioning lever 421 pivots about the shaft 421*a*, so that the engagement is released. Also, when the solenoid 425 is deenergized, the positioning lever 421 is pivoted clockwise by the spring force about the shaft 421*a* so that the positioning pin 427 abuts the outer periphery of the stopper member 332. The positioning pin 427 is in rolling contact with the circular outer periphery of the stopper member 331 so that it rotates by the rotation of the rotary assembly 300, until it is again engaged with the next cut-away portion 332. At the instance when the positioning pin 427 is engaged into the cut-away portion 332, an end of the positioning lever 421 intercepts an optical path of unshown photo-interrupter which then produces a signal, in response to which the driving force to the rotary assembly 300 is shut off.

Figure 10:
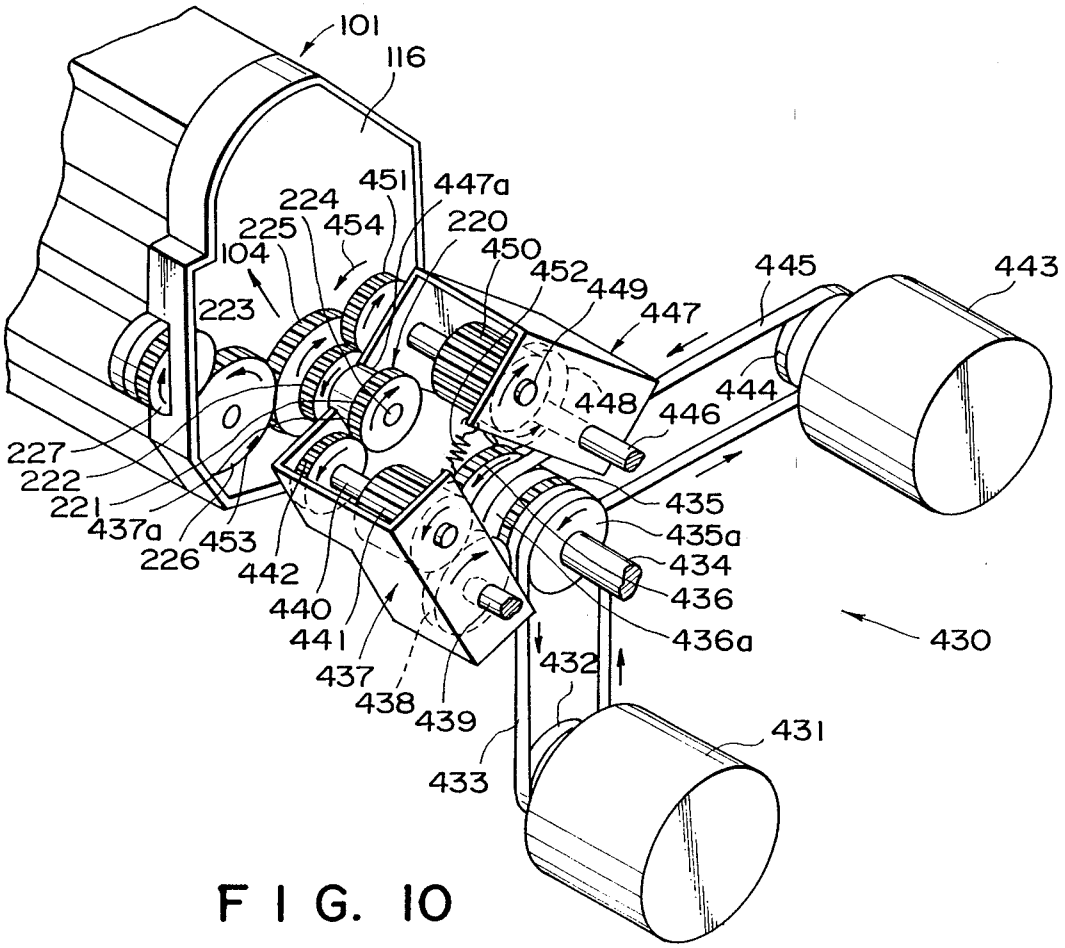
FIGS. 10 and 11 are perspective views of a driving device for supplying driving power to each of the developing units.

Referring to FIG. 10, means 430 for driving the developing units according to the embodiment of the present invention, will be described. FIG. 10 is an enlarged perspective view of the developing unit driving means 430 shown in FIG. 9. The driving means 430 drives the developing roller 130 or the like when the developing unit is stopped at the developing position.

In this embodiment, each of the developing units is provided with means 220 for receiving the driving force, which is projected outwardly from the end plate 116, as shown in FIG. 10. The driving force receiving means 220 is rotatably supported in the end plate 116 and is effective to transmit the rotational driving force to the developing roller 130 and the stirring screws 118 and 119 in this embodiment. The force receiving means 220 in this embodiment comprises an input shaft 224, the gear 221 fixedly mounted to the input shaft 224 and a gear 222 rotatably mounted on the input shaft 224. Therefore, the developing unit is able to receive two types of driving forces. A limiter roll 223 is rotatably mounted to the input shaft 224 between the gear 221 and the gear 222 for a the purpose which will be described hereinafter.

On the other hand, the driving means 430 comprises first and second housings 437 and 447 which are opposed to each other. The first and second housings 437 and 447 are supported swingably on the respective shafts 439 and 446 which are spaced apart and fixed onto the frame of the copying apparatus, at the ends of the housing. At the other ends of the housings, they are attracted toward each other by a tension spring 452.

A gear 438 is rotatably mounted on the shaft 439. The first housing 437 further includes a rotatable shaft 440 to which gears 441 and 442 are fixed. The gear 441 is in meshing engagement with the gear 438. Also to the shaft 447, a gear 448 is rotatably mounted, which gear is meshed with a gear 450 fixed to a shaft 449 rotatably mounted to the second housing 447. Further, a gear 451 is fixed to the shaft 449.

The gears 438 and 448 are respectively meshed with the driving gears 435 and 436 which are rotatably mounted on a shaft 434 fixed to the frame of the copying apparatus. The driving gears 435 and 436 are provided with pulleys 435*a* and 436*a*, respectively, which are integral therewith. Therefore, to the driving gear 435, the driving force is transmitted from the motor 431 through the pulley 432 fixed on the output shaft of the motor 431 and a timing belt stretched about the pulleys 432 and 435*a*. To the driving gear 436, the driving force is transmitted from the motor 443 through the pulley 444 fixed to the output shaft of the motor 443 and a timing belt 445 stretched about the pulleys 444 and 436*a*. The rotation of the driving gear 435 is transmitted to the gear 442 through the gears 438 and 441. The rotation of the driving gear 436 is transmitted to the gear 451 through the gear 450.

When the developing unit is rotating to be positioned at the developing position, the force receiving means 220 of the developing unit enters the space formed between the first and second housings 437 and 447 of the driving means 430 from the shaft (439 and 446) side with the rotation of the rotary assembly 300, in the direction of an arrow 104. When a desired developing unit is positioned correctly at the developing position, the gears 221 and 222 of the force receiving means 220 is meshed with the output gears 442 and 451 of the driving means 430, respectively, as shown in FIG. 10. At this time, ends 437*a* and 447*a* of the first and second housings 437 and 447 are abutted to the limiter roll 223 of the receiving means 220 so that the intervals between the axes of the gears 442 and 221 and between the axes of the gears 451 and 222 are maintained properly so proper backlashes are assured therebetween. The gear 221 rotates with the input shaft 224 while the gear 222 is rotatable relative to the input shaft 224, so that the receiving means 220 is able to transmit the driving force to the other gear (not shown) in the developing unit. In this embodiment described above, the sleeve 132 of the developing roller 130 is rotated by the rotation of the gear 221 through the gear 225 fixed on the input shaft 224, through the gear 226 and through the gear 227. To the gears 225 and 226, the above-described stirring screws 118 and 119 are operatively coupled, respectively, so that the stirring screws are rotated. The gear 222 transmits the driving force to the magnet roller 131.

In the structure described above, the meshing movements between the gears 442 and 221 and between the gears 451 and 222 involve the rotational moment about the respective shafts 429 and 446 in the directions 453 and 454, respectively. The direction of the moments are such as to promote the meshing engagement. Therefore, the meshing engagement is not released during the operation with the result of desirable drive transmission.

Figure 11:
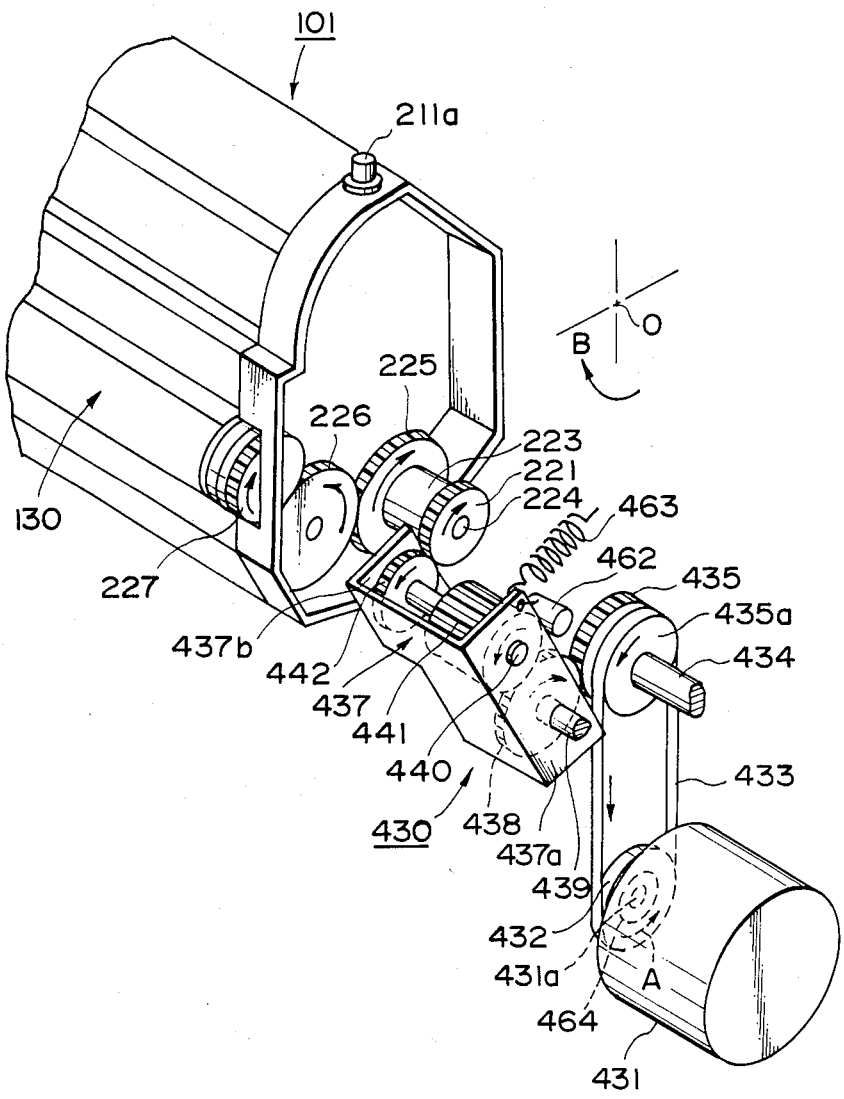
Figure 12:
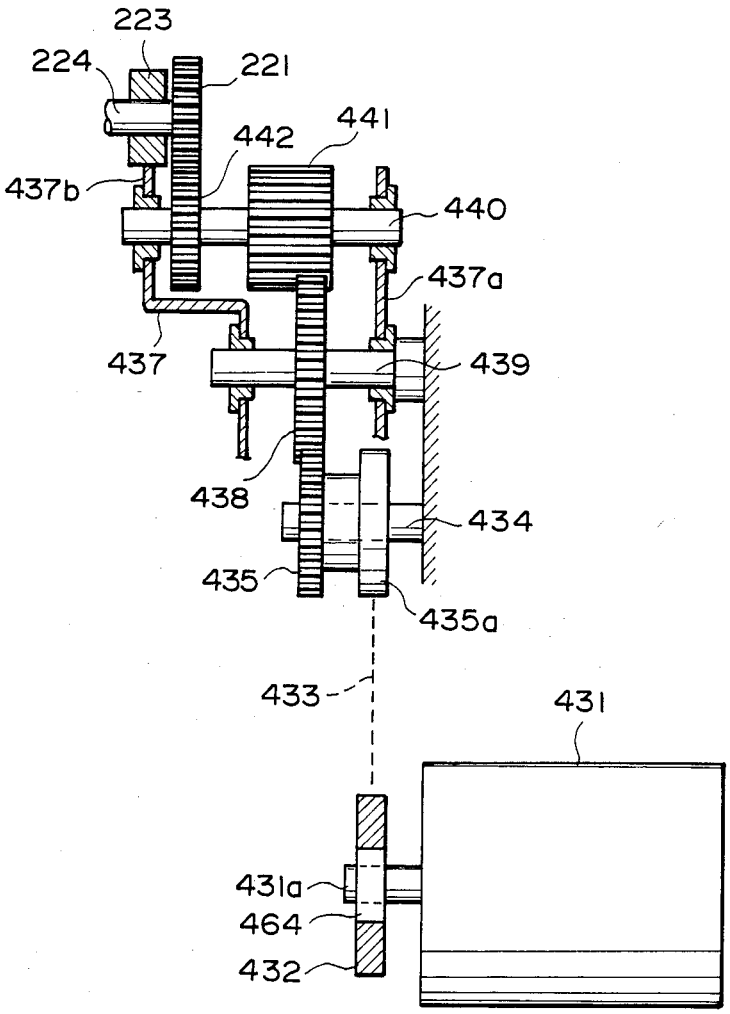
FIG. 12 is a schematic diagram of the driving device of FIG. 11.

FIGS. 11 and 12 illustrate another embodiment of the driving mechanism, wherein only one of the housing, more particularly, the first housing 437 only is employed, as contrasted to FIG. 10 embodiment. The detailed explanation has been omitted by assigning the same reference numerals to the corresponding elements for the sake of simplicity of explanation, when the foregoing explanation applies.

The housing 437 is urged by a spring 463 so as to move the gear 442 in the direction of meshing engagement with the gear 221. The side plate 437*a* of the housing 437 abuts to a regulating pin 462 so that the amount of swinging movement of the housing 437 is limited. More particularly, prior to the gear 442 being engaged with the input gear 221 of the developing unit 101, the side plate 437*a* abuts the pin 462 so that the housing 437 rests. When the gear 442 is meshed with the input gear 221 on the other hand, the side plate 437*b* of the housing abuts the roll 223 so that the interval between the centers of the gears 442 and 221 is maintained at a proper level. In this embodiment, the rotational moment is applied to each of the gears 221 and 442 about the shaft 439 in the direction of promoting the meshing engagement therebetween so that the unintentional release of the engagement does not occur. The output rotation of the driving motor 431 is transmitted through the timing belt 432 to the pulley 435 and to gears 435, 438, 441 and 442, and then to the input gear of the developing unit. The rotation of the gear 221 is transmitted to the gears 225, 226 and 227 whereby the stirring screws 118 and 119 and the sleeve 132 of the developing roller are rotated. In this embodiment, the magnet roller 131 within the sleeve 132 is stationary.

In this embodiment, there is a one way clutch 464 between the output shaft 431*a* of the driving motor 431 and the pulley 432. The one way clutch 464 is effective to rotate the output shafts 431*a* and the pulley 432 when the output shaft 431*a* rotates in the direction of an arrow A.

As shown in FIG. 11, the center of rotation of the rotary assembly 300 is indicated by "O". Therefore, the developing unit, 101 for example, revolves about the center O in the direction of an arrow B toward the developing station (FIG. 11). Before the driving means 430 engages with the input gear 221 of the developing unit 101, the housing 437 is positioned so as to be engaged to the stopper pin 462, whereby the position of the driving gear 442 is slightly nearer to the center O than when the gear 442 is in meshing engagement with the developing unit. When the developing unit 101 rotates in the direction of the arrow B, the input gear 221 is first brought into contact with the driving gear 442 from the bottom right as seen in FIG. 11, and the developing unit enters the developing position with the force of rotating the driving gear 442 in the direction of the arrow. Due to the one way clutch 464, the rotor and the gear head of the motor 431 is not rotated so that the pulley 432 rotates idly about the output shaft of the motor 431 whereby the driving gear 442 is able to smoothly rotate when the input gear 221 enters. The one way clutch 464 may be provided to the shaft 440. Instead, the one way clutch 464 may be provided between the input shaft 224 and the input gear 221 of the developing unit. In this case, however, the one way clutch 464 has to be provided for each of the developing units. Preferably, therefore, the one way clutch is provided on the driving device (439) side. In this embodiment, the clutch 464 is provided at the upstream side of the drive transmission path of the driving device 430 with respect to transmission of the force so as to release the shock or cramp which may be caused by the engagement between the gears 221 and 442 by the backlashes from the gear 435 to the gear 442. In the foregoing, the clutch 464 has been described as being a one way clutch for allowing the rotation in only one direction. However, another clutch is usable which is mechanically or electrically controlled so as to shut or connect the driving force between the motor 31 and the driving gear 442, as desired.

In the FIG. 10 embodiment described here-inbefore, it is also desirable to use such clutch means in the drive transmission passage in order to smoothly contact the driving gear of the driving device and the input gear of the developing unit.

In any case, as shown in FIGS. 10 and 11, a single driving device 430 is sufficient to provide the desired one of the plural revolvable developing units with the driving force externally in the preferred manner, and the developing roller and the stirring screws in the developing unit can be driven. Importantly, it is not necessary to provide each of the developing units with the driving mechanism so that the structure of the developing unit is simplified, making the maintenance operation easier for the developing units.

In FIGS. 10 and 11 embodiments, the stirring screws are rotated together with the developing roller, only the developing roller may be driven to be rotated when the stirring screws are not required. Further, in the structure of the developing device having a sleeve and a magnet roller, only the magnet roller may be driven by the driving device so that the present invention is not limited to the structures of FIGS. 10 and 11. In either of FIGS. 10 and 11, the rotary assembly 300 is rotated after one developing operation completes, so as to effect the next developing operation. The developing unit 101 is moved in the direction of the arrow B (FIG. 11). With this movement, the gear 221 is released from the driving gear 442.

Next, the description will be made as to the method of detaching the developing unit will be described.

Figure 13:
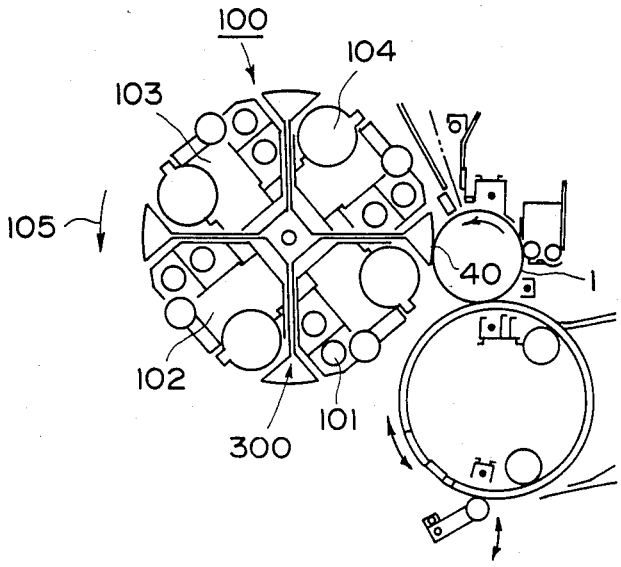
FIG. 13 is a schematic cross-section of the developing device showing a home position.

FIG. 13 shows the rotatable developing device 100 when it is positioned at its home position wherein the developing unit 104 is in its detachable position.

Figure 14:
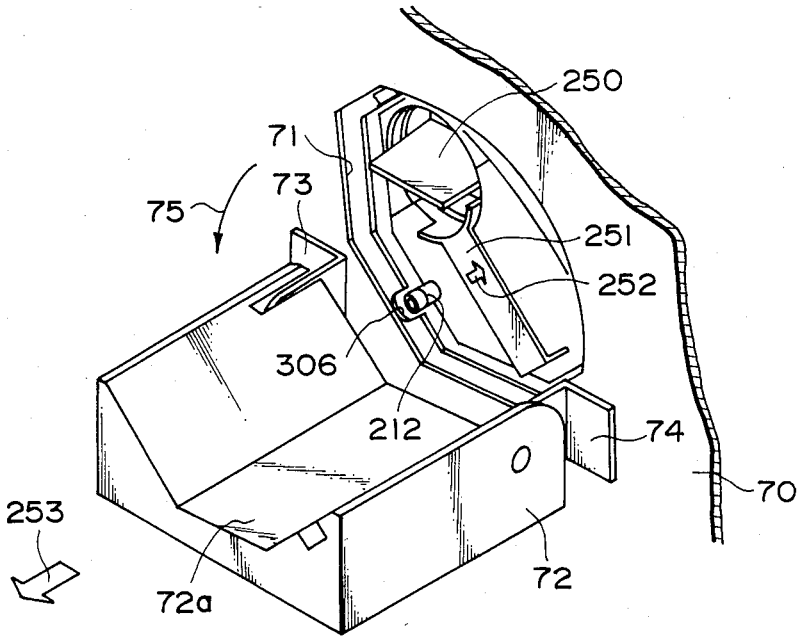
FIG. 14 is a perspective view of a part of the copying apparatus, illustrating an opening and door for attaching the developing unit.

As shown in FIG. 14, the front plate 70 of the copying apparatus is provided with an opening 71 for allowing the mounting or demounting of the developing unit. Adjacent to the bottom of the opening 71, a door 72 is provided. The door 72 is pivotably mounted to the copying apparatus through brackets 73 and 74. FIG. 14 shows the position of the door which is opened in the direction of an arrow 75. When the door 72 is pivotted oppositely, the opening 71 is closed. There is provided a switch (not shown) for stopping the supply of the driving power to the rotatable developing device 100, when the door 72 is opened as shown in FIG. 14. Further, by the opening operation of the door 72, the driving means 400 for the rotary assembly 300 is mechanically braked. More particularly, the driving means 400 is operatively coupled a mechanical braking means, which comprises a brake wheel 406 integrally fixed to the shaft 407 of the gear 403 and the brake shoe 411 urged to the surface of the brake wheel 406 (FIG. 9). The brake shoe 411 is mounted to the operating lever 410 pivotable about a shaft 409. The brake shoe 411 is urged to the brake wheel 406 by a spring 412 stretched to the operating lever 410. However, a wire 413 is connected between the operating lever 410 and the door 72 so that when the door 72 closes the opening 71, the wire 413 pulls the operating lever 410 against the spring force of the spring 412 to prevent the brake shoe 411 from being urged to the brake wheel 406.

Therefore, when the door 72 is opened as shown in FIG. 14, the wire 413 becomes loose, and the operating lever 410 is pivoted by the spring 412 so that the brake shoe 411 is urged to the brake wheel 406. By this means, the mechanical braking force is applied to the driving means 400. In FIG. 14, when the door 72 is opened, the front part of the developing unit is exposed through the opening 71 of the front plate of the apparatus, and the toner cartridge 250 above the toner chamber 113 of the developing unit is also disclosed. The toner cartridge 250 is in the form of a known cylindrical structure, and is detachably inserted into the toner cartridge accommodating portion in the toner chamber 113. The toner cartridge supplies toner into the toner chamber 113. Next, the means for mounting the developing unit into the rotary assembly 300 will be described. As will be readily understood from the FIGS. 2, 3 and 4, the developing units 101, 102, 103 and 104 are accommodated in the developing unit accommodating chambers 325*a*, 325*b*, 325*c* and 325*d* of the rotary assembly 300 in a proper manner, and are supported by the rails 321 disposed above and below each of the developing units.

Since the upper and lower rails 321, which define the accommodating chamber and serve to support the developing unit, are of the same structure, and therefore, the structure of the upper rail 321 supporting the developing unit 101 in FIG. 2 will be described.

Figure 15:
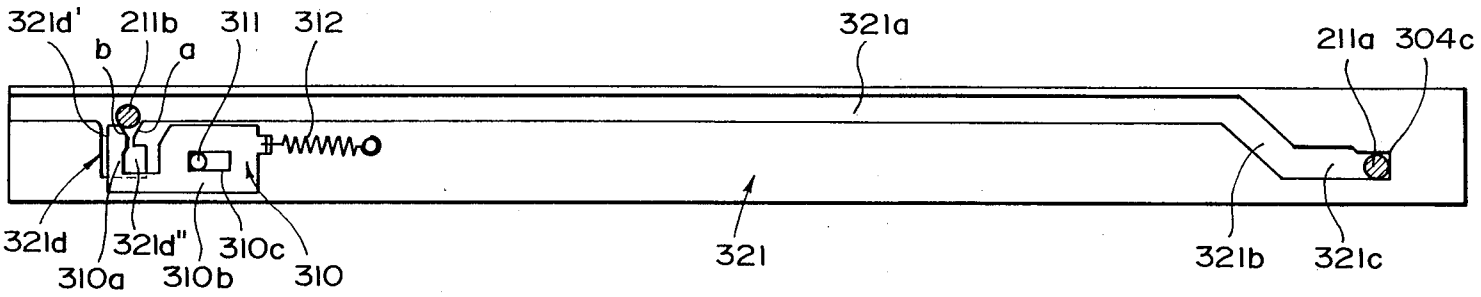
FIGS. 15 and 16 are front views of a rail of the rotary member illustrating the relation between a guiding groove of the rotary member and a positioning tin of the developing unit.

As shown in FIG. 15, the developing unit carrying surface of the upper rail 321 is provided with a guiding groove 321*a* for engagement with pins 211*a* and 211*b* planted in the top surfaces of the end plates 115 and 116 of the developing unit. The guiding groove 321*a* extend parallel to the rotational axis of the rotary assembly 300. However, at the rear side (righthand side in FIG. 15) of the rotary assembly 300, there is provided an end groove 321*c* offset toward the center of the rotary assembly 300, and the guiding groove 321*a* and the end guiding groove 321*c* are connected by an inclined groove 321*b*.

Adjacent to the front side of the guiding groove 321*a*, that is, the entering portion, there is formed a locking groove 321*d* in a generally "L" shape as shown in FIG. 15. The locking groove 321*d* includes a vertical portion 321*d*′perpendicular to the guiding groove 321*a* and a horizontal portion 321*d*″extending parallel to the guiding groove 321*a* from the vertical portion 321*d*′. Further, on the bearing surface of the upper rail 321, there is provided a hook 310 for cooperating with the locking groove 321*d* to lock the pin 211*b* of the developing unit. The hook 310 includes a pawl 310*a* and the body 310*b* which is provided with an elongated slot 310*c*. The slot 310*c* is slidably engaged with the pin 311 planted in the rail 321. A tension spring 312 is connected to the body 310*b*. Therefore, the hook 310 is biased rightwardly as seen in FIG. 15, and is stopped by the pin 311 abutting an end of the slot 310*c*.

Figure 16:
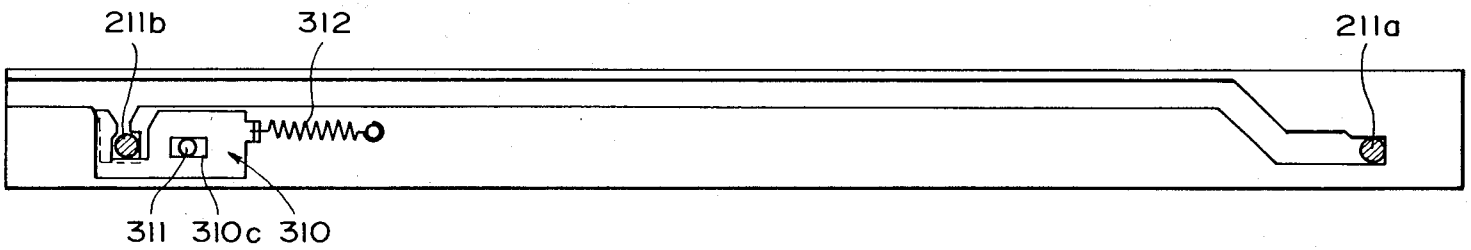

When the developing unit is mounted into the rotary assembly 300, the pins 211*a* and 210*a* at the rear side of the developing unit are engaged with the guiding grooves 321*a* of the upper rail and the lower rail, and the developing unit is inserted along the guiding grooves 321*a*. FIG. 15 shows the state wherein the developing unit has just been inserted into the rotary assembly 300. In this state, the front side pins 211*b* and 210*b* (not shown) of the developing unit are in a groove constituted by a taper portion a of the vertical portion 321*d* of the locking groove and the taper portion b of the hook. When a grip 251 of the developing unit is pushed in the direction opposite to the arrow 252 of FIG. 14, the pin 211*b* of the developing unit is locked into the locking groove 321*d* while shifting leftwardly the pawl 310*a* against the spring force by the spring 312. The pin 211*b* now in the locking groove 321*d* is locked by the pawl 310*a* of the hook 310 and the horizontal portion 321*d*″ of the locking groove (FIG. 16). Simultaneously, the front side pin 211 of the developing unit is engaged by the cut-away portion 306 of the central plate 303 of the rotary assembly 300 so that the loading of the rotary assembly with the developing unit completes.

When the developing unit is to be removed from the rotary assembly 300, the grip 251 of the developing unit is pulled in the direction of an arrow 252 (FIG. 14), so that the pin 211*b* is disengaged from the hook 310, with the result that the developing unit now takes the position shown in FIG. 15. At this time, the front side pin 212 of the developing unit is disengaged from the cut-away portion 306 of the rotary assembly 300. Then, the developing unit is pulled out of the rotary assembly 300 by the grip 251 in the direction of the arrow 253 of FIG. 14.

Figure 17:
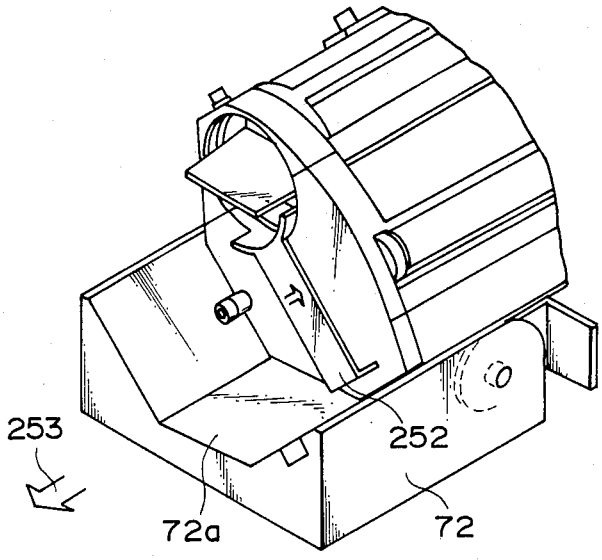
FIG. 17 is a perspective view of a part of the developing unit partly projected through the opening.

As shown in FIG. 14, the upper surace 72*a* of the opened door 72 is in alignment with the opening 71 of the front plate of the apparatus and has the same configuration as that of the developing unit so as to guide the developing unit when it is draw out. This is shown in FIG. 17.

Thus, each of the developing units can be set in the rotary assembly with a simple operation and with proper precision.

Further, the embodiment of the present invention involves the following improvements.

Figure 18:
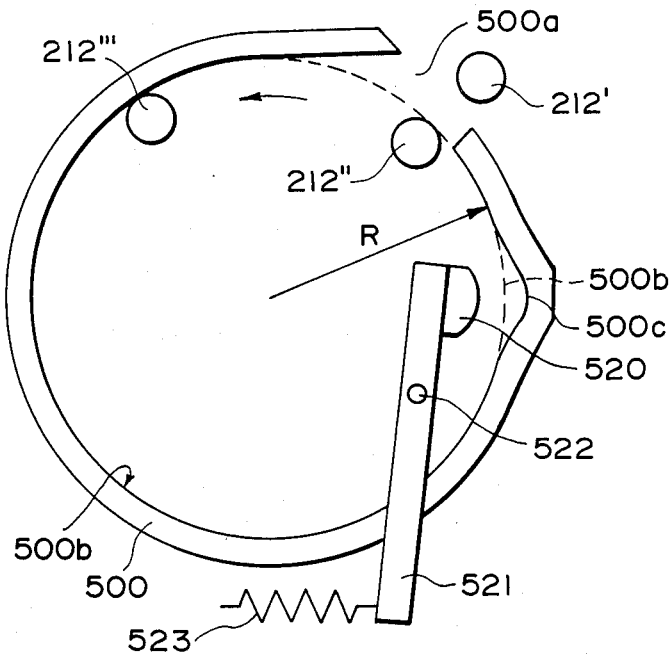
FIGS. 18 and 19 are schematic cross-sections illustrating the relation among a confining member, the developing unit, the photosensitive drum and a cam for positioning the developing roller.
Figure 19:
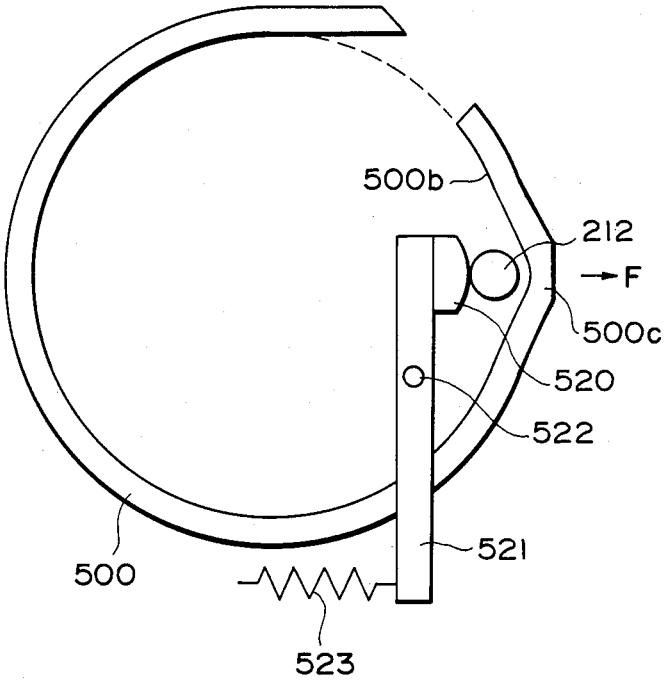

As shown in FIGS. 18 and 19, a confining member 500 is provided inside the front plate 70 of the copying apparatus in order to prevent the developing unit from coming out of the rotary assembly 300 during the developing unit revolving together with the rotation of the developing device. The confining member 500 is in the shape of a generally circular ring having a common center with the rotational axis of the rotary member 300. A partial opening 500*a* is formed so as to allow the pin 212 of the developing unit to enter the ring, when the developing unit is loaded in the rotary assembly 300. When the developing unit revolves, the pin 212 slides on the inner surface 500*b* of the confining member 500, thus preventing the developing unit from coming out of the rotary assembly 300 by the centrifugal and gravity forces during rotation of the rotary assembly 300.

In FIG. 18, indicated by reference 212″ is the state of a pin when the positioning pins 210*b* and 211*b* of the developing unit are not engaged by the hook 310 of the rotary assembly (FIG. 15); whereas indicated by reference 212″ is the state of the pin when the positioning pins 210*b* and 211*b* of the developing unit are in engagement with the hook 310 of the rotary assembly (FIG. 16), that is, the developing unit is completely loaded in the rotary assembly 300. When the rotary assembly rotates, the developing unit revolves, and the pin 212 slides on the inner surface 500*b* of the confining member 500 as indicated by the reference 212‴.

As shown in FIG. 18, there is provided a cam 520, inside the confining member 500 for positioning the developing roller. The cam 520 is formed adjacent an end of a cam lever 521 pivotably mounted about a pin 522, and the other end of the cam lever 521 is connected to a spring 523 to urge the cam 520 to the inner surface 500*b* of the confining member 500.

The portion 500*c* of the inner surface opposed to the cam 520 is recessed, that is, projected radially outwardly. Therefore, when the pin 212 of the developing unit comes to this portion with the rotation, the pin 212 receives the force from the cam 520 toward the outside, that is, the pin 212 is pushed outwardly from the normal circular race having the radius of R (FIG. 19).

The developing unit is supported on the rotary assembly 300 such that it is swingable about the pins 211*a* and 210*a*, and therefore, the developing unit is urged toward the photosensitive drum 1 by the outward force.

Figure 20:
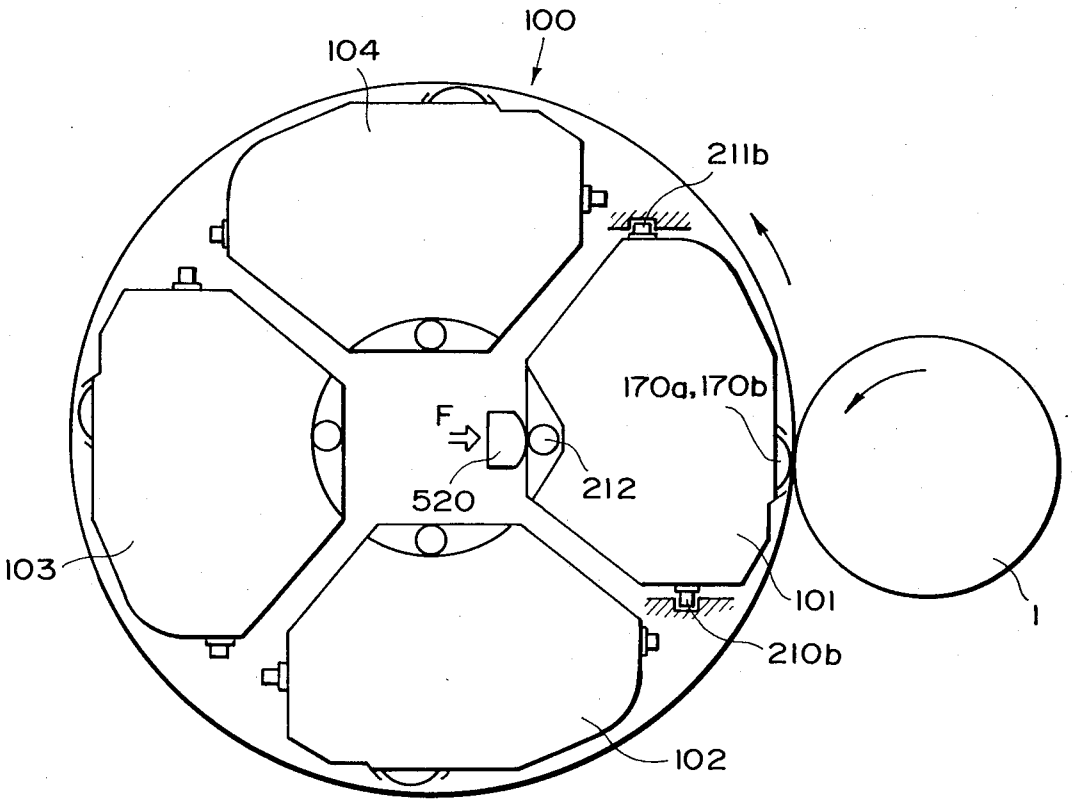
FIG. 20 is a schematic side view of the developing unit, photosensitive drum, and the mechanism for accurately setting the distance therebetween.

On the other hand, the opposite longitudinal ends of the developing roller 130 are provided with a spacer for assuring the gap between the sleeve 132 and the drum 1. The spacer includes rotatable rolls or disk 170*a* and 170*b* having a diameter slightly larger than that of the outer diameter of the sleeve 132 (FIG. 2 and FIG. 3). Therefore, the urging force by the cam 520 brings the rolls 170*a* and 170*b* into contact with the longitudinal end portions of the photosensitive drum 1, so that the distance between the photosensitive drum surface and the sleeve surface is set accurately (FIG. 20).

Upon completion of the developing operation, the pin 212 disengages from the space from the cam 520 and the inner surface 500*c* of the confining member 500 and slides again on the inner surface 500*b* by the rotation of the rotary assembly 300.

When the developing unit is removed from the rotary assembly 300, the pin 212 of the developing unit is disengaged from the cut-away portion 306 of the rotary assembly 300, as described hereinbefore. At this time, the pin 212 is simultaneously disengaged from the confining member 500 through the opening or slot 500*a* of the confining member 500.

In this manner, the developing unit is effectively prevented from undesirably coming out of the rotary assembly, and simultaneously, the distance between the surface of the developing roller and the surface of the photosensitive drum can be correctly set so as to assure the proper developing operation.

As described, according to the present invention, it is not necessary that each of the developing units has the driving source, and therefore, the developing device can be made simpler in construction. Furthermore, the driving force can be transmitted with certainty to the developing unit.

While the invention has been described with reference to the structures disclosed herein, it is not confined to the details set forth and this application is intended to cover such modifications or changes as may come within the purposes of the improvements or the scope of the following claims.

What is caimed is:

1. A color image forming apparatus, comprising:

a latent image bearing member;

means for developing a latent image formed on said latent image bearing member, including a plurality of developing units and a rotatable assembly for carrying the plurality of developing units, said developing units each having means for carrying developer and supplying the developer to the latent image, wherein at least one of said developing units is selectively movable to a developing position for developing the latent image; and driving means for driving said developer carrying means, said driving means being common to all of the developer carrying means of said plurality of developing units, and being actable on the developing unit placed at the developing position to apply a driving force only to the thus placed developing unit, wherein said developing units each include a first gear operatively connected to said developer carrying means and where in said driving means includes a second gear operatively conenctable to said first gear to drive said developer carrying means.

2. An apparatus according to claim 1, wherein said second gear is pivotably supported, and wherein said driving means further includes means for urging said second gear toward said first gear beyond a pivot of said piotable movement and means for limiting the pivotable movement of said second gear.

3. An apparatus according to claim 1, wherein said driving means further includes means for regulating a distance between a center of said first gear and a center of said second gear when they are in meshing engagement.

4. An apparatus according to claim 1, wherein said driving means includes a driving source for driving said second gear, and a clutch which is rotatable only in one direction and disposed in a transmission passage from said driving source to said second gear.

5. An apparatus according to claim 1, wherein said developing unit includes a member for stirring the developer, the stirring member being driven by said driving means together with said developer carrying means.

6. An apparatus according to claim 1, wherein said developer carrying means includes a developing sleeve and a magnet roller provided within said developing sleeve.

7. An apparatus according to claim 6, wherein said driving means drives said developing sleeve to rotate it.

8. An apparatus according to claim 6, wherein said driving means drives said magnet roller to rotate it.

9. An apparatus according to claim 6, wherein said driving means drives said developing sleeve and said magnet roller to rotate them in the opposite directions.

10. An apparatus according to claim 1, wherein each of said developing units includes a spacer for forming a space between said developer carrying means and said latent image bearing member, and wherein said image forming apparatus includes means for urging the developing unit which is disposed at the developing station, toward said latent image bearing member, wherein when one of the plural developing units is placed at the developing position, said urging means urges so that said spacer is brought into contact with the latent image bearing member to form a predetermined clearance between a surface of the developer carrying means and a surface of said latent image bearing member.

11. An apparatus according to claim 10, wherein said developer carrying means includes a developing sleeve for carrying the developer, and said spacer is provided at each end portion of said developing sleeve, and wherein said spacers are brought into contact to end portions of said latent image bearing member by an urging force provided by said urging means.

12. An apparatus according to claim 1, wherein said developing units are detachably mounted on said rotatable assembly.

13. An apparatus according to claim 1, wherein said plural developing units contain different color developers, respectively.

14. An apparatus according to claim 1, wherein when a selected one of said plurality of developing units is set at the developing position, a drive force applying path is established between said driving means and said developer carrying means, and when the selected developing unit is to move away from the developing position, said drive force applying path is discontinued.

15. An apapratus according to claim 1, wherein said driving means comprises first and second driving means, wherein said second driving means is separate from said first driving means, and is for rotating the rotatable assembly.

16. A color image forming apparatus comprising:

a latent iamge bearing member;

means for developing a latent image formed on said latent image bearing member including a plurality of developing units and a rotatable assembly for carrying said plurality of developing units, wherein said developing units each have means for carrying developer and supplying the developer to the latent image, wherein at least one of said developing units is selectively movable to a developing position for developing the latent image;

driving means for driving said developer carrying means, wherein said driving means is common to all of said developer carrying means of said plurality of developing units;

first gear means associated with each of said plurality of developing units;

second gear means, driven by said driving means, for meshing engagement with said first gear means to transmit the driving force of said driving means to said developer carrying means;

wherein when a selected one of said plurality of developing units is set at the developing position, said second gear means engages said first gear means so as to supply the driving force only to said developer carrying means of said selected developing unit, and when said selected developing units is moved away from the developing position, the engagement between said first gear means and said second gear means is released, so that the transmission of the drive force to said developer carrying means is discontinued.

17. An apparatus according to claim 16, wherein said driving means comprises first and second driving means, wherein said second driving means is separate from said first driving means, and is for rotating the rotatable assembly.

* * * * *

UNITED STATES PATENT AND TRADEMARK OFFICE

CERTIFICATE OF CORRECTION

PATENT NO. : 4,743,938

DATED : May 10, 1988

INVENTOR(S) : AKIO OHNO

It is certified that error appears in the above-identified patent and that said Letters Patent is hereby corrected as shown below:

COLUMN 1

Line 13, "desired," should read --desired--.
Line 23, "electrophotograpic" should read --electrophotographic--.
Line 31, "has increasing" should read --has been increasing--.
Line 33, "ordinally" should read --ordinary--.
Line 37, "electrophotograpic" should read --electrophotographic--.
Line 58, "necessiates" should read --necessitates--.
Line 67, "much" should read --must--.
Line 68, "the" (second occurrence) should be deleted.

COLUMN 2

Line 57, "a" (first occurrence) should be deleted.

COLUMN 3

Line 33, "positioning tin" should read --positioning pin--.
Line 65, "electrophotograpic" should read --electrophotographic--.

COLUMN 5

Line 34, "to" should be deleted.
Line 48, "manner a," should read --manner, a--.

UNITED STATES PATENT AND TRADEMARK OFFICE

CERTIFICATE OF CORRECTION

PATENT NO. : 4,743,938

DATED : May 10, 1988

INVENTOR(S) : AKIO OHNO

It is certified that error appears in the above-identified patent and that said Letters Patent is hereby corrected as shown below:

COLUMN 6

Line 41, "main" (first occurrence) should be deleted.

COLUMN 7

Line 29, "ber" should read --bers--.

COLUMN 10

Line 12, "a" should be deleted.
Line 47, "supplyig" should be --supplying--.

COLUMN 11

Line 44, "the" (second occurrence) should be deleted.

COLUMN 12

Line 59, "to" should be deleted.

COLUMN 13

Line 57, "motor 31" should read --motor 431--.
Line 59, "here-inbefore," should read --hereinbefore,--.

COLUMN 14

Line 20, "the description will be made as to" should be deleted.
Line 32, "pivotted" should read --pivoted--.
Line 40, "coupled a" should read --coupled to a--.

UNITED STATES PATENT AND TRADEMARK OFFICE

CERTIFICATE OF CORRECTION

PATENT NO. :4,743,938

DATED :May 10, 1988

INVENTOR(S) :AKIO OHNO

It is certified that error appears in the above-identified patent and that said Letters Patent is hereby corrected as shown below:

COLUMN 15

Line 16, "extend" should read --extends--.

COLUMN 16

Line 8, "surace" should read --surface--.
Line 12, "draw" should read --drawn--.
Line 35, "reference 212"" should read --reference 212'--.
Line 68, "disk" should read --disks--.

COLUMN 17

Line 38, "caimed" should read --claimed--.
Line 59, "where in" should read --wherein--.
Line 60, "conenctable" should read --connectable--.
Line 67, "piotable" should read --pivotable--.

UNITED STATES PATENT AND TRADEMARK OFFICE

CERTIFICATE OF CORRECTION

PATENT NO. : 4,743,938

DATED : May 10, 1988

INVENTOR(S) : AKIO OHNO

It is certified that error appears in the above-identified patent and that said Letters Patent is hereby corrected as shown below:

COLUMN 18

Line 43, "to" should read --with--.
Line 59, "apapratus" should read --apparatus--.
Line 65, "iamge" should read --image--.

COLUMN 20

Line 6, "units" should read --unit--.

Signed and Sealed this

Nineteenth Day of September, 1989

*Attest:*

*Attesting Officer*

DONALD J. QUIGG

*Commissioner of Patents and Trademarks*